US010329767B2

(12) United States Patent
Yin et al.

(10) Patent No.: US 10,329,767 B2
(45) Date of Patent: Jun. 25, 2019

(54) GRID DECK WITH SHEAR-RESISTING PLATES

(71) Applicant: RUENTEX ENGINEERING & CONSTRUCTION CO., LTD., Taipei (TW)

(72) Inventors: Samuel Yin, Taipei (TW); Kun-Jung Shu, Taipei (TW)

(73) Assignee: RUENTEX ENGINEERING & CONSTRUCTION, CO., LTD., Taipei (TW)

( * ) Notice: Subject to any disclaimer, the term of this patent is extended or adjusted under 35 U.S.C. 154(b) by 0 days.

(21) Appl. No.: 15/815,796

(22) Filed: Nov. 17, 2017

(65) Prior Publication Data

US 2019/0071871 A1 Mar. 7, 2019

(30) Foreign Application Priority Data

Sep. 7, 2017 (TW) ..... 106213265 U

(51) Int. Cl.

| | |
|---|---|
| ***E04C 5/06*** | (2006.01) |
| ***E04B 5/02*** | (2006.01) |
| *E04C 2/42* | (2006.01) |
| *E04B 5/04* | (2006.01) |

(52) U.S. Cl.

CPC ..... *E04C 5/0645* (2013.01); *E04B 5/023* (2013.01); *E04B 5/026* (2013.01); *E04B 5/046* (2013.01); *E04C 2/422* (2013.01)

(58) Field of Classification Search

CPC ..... E04C 5/0645; E04C 2/422; E04B 5/026; E04B 5/023; E04B 5/046

See application file for complete search history.

(56) References Cited

U.S. PATENT DOCUMENTS 976,183 A * 11/1910 Jones ..... E04F 15/04 52/252
2,920,475 A * 1/1960 Graham ..... B28B 23/0006 249/13
3,884,005 A * 5/1975 Wey ..... E04B 1/043 403/294
5,402,616 A * 4/1995 Klein ..... B28B 23/0056 52/578

* cited by examiner

*Primary Examiner* — Patrick J Maestri

(74) *Attorney, Agent, or Firm* — Juan Carlos A. Marquez; Marquez IP Law Office, PLLC

(57) ABSTRACT

The present invention relates to a grid deck with shear-resisting plates and the assembly of the grid decks. The shear-resisting plates are pre-cast in the grid deck and protrude from the side surfaces thereof. When the grid decks with shear-resisting plates are assembled, they are laid on the beams with the shear-resisting plates contacting the beams and without the grid decks contacting the beams.

9 Claims, 5 Drawing Sheets

GRID DECK WITH SHEAR-RESISTING PLATES

TECHNICAL FIELD

This invention is directed to a grid deck with shear-resisting plates, wherein the shear-resisting plates are pre-cast in the grid deck and partly protrude from the side thereof.

BACKGROUND

In the construction techniques, a pre-casting method is usually adopted in order to save construction time. In the pre-casting method, the components, such as beams, columns, and decks, are pre-casted off the construction site and are then transported to the construction site for subsequent assembling and grouting. Accordingly, the space at the construction site would be less taken up and support frames used for construction would be greatly reduced. Therefore, the working flow line would be much better. The on-site construction time would be significantly reduced. Since the beams, columns, and decks are produced in the workshop, away from the construction site, the production rate, precision and quality thereof can easily be monitored and reach the expected level. Accordingly, the pre-casting method has become the mainstream for the current construction technology.

Grid decks are widely used in the construction of plants, particularly, those for a wafer factory. Grid decks can be produced on-site through grouting or in a pre-casting workshop. The grid decks contain rebar, which reinforces the strength thereof. The grid decks also have hollow portions which effectively reduce the weight thereof.

When building a plant, the pre-cast grid decks are laid over the pre-cast columns in a suitable span so that on-site construction is simplified, and thus the construction time is significantly reduced.

A normal grid deck assembly is shown in FIG. 1. The connecting bars 71, 81 protrude from the sides of the grid decks 70, 80, respectively. The connecting bars 71, 81 further connect the lap-joint bars 91. When grid decks are paved, they are laid on the I-beam 60 with gaps therebetween. Grout is filled into the gaps formed between the grid decks 70, 80. After the grout is cured, the grid decks 70, 80 will be connected to each other and fixed.

The gaps between grid decks 70, 80 can be too small so that the overlap length between the lap-joint bars 91 and connecting bar 71 or 81 can be too short and the strength created by the lap joint can be insufficient after the grout is cured. Although the strength can be increased when more connecting bars and lap-joint bars are provided or the width of the gap between the I-beam is used, these two methods will cause an inconvenience to the on-site construction and pre-cast production and make the costs higher. To overcome these problems, an improved method is provided, in which a recess 24, 34 is created on each of the grid decks 20, 30 to be connected as shown in FIG. 2. Connecting bars 21, 22, 23 and connecting bars 31, 32, 33 protrude from grid deck 20 and 30, into the recess 24, and 34, respectively. Connecting bars 21, 22, 23 and connecting bars 31, 32, 33 are connected by a lap-joint bar 50. Grout is filled in the gap between the grid decks to be assembled. With the recesses 24, 34, the gap between grid decks 20, 30 is wider than that without recesses. The wider gap makes the contact area between the connecting bars, the lap-joint bars and the cement (grout) larger, and thus the strength of connection between the grid decks would be increased.

The grid decks with a recess still have the problem of insufficient depth of the recess in some occasions, and when the width of the I-beams is small, there is also a problem of insufficient gap width between the grid decks, which thus causes insufficient connection strength between the grid decks. Accordingly, there is a need to improve the connection of the grid decks.

SUMMARY OF INVENTION

The objective of the present invention is to overcome the problem of insufficient strength of the connection between grid decks.

When grid decks are paved, they are laid on top of the beams. Accordingly, the bottom surface of the grid decks contacts the top surface of the beams. For each beam, each of the two edges of the top surface of the beam contacts one grid deck. Accordingly, the gap between the grid decks is limited by the width of the beam. The insufficient width of the gap will result in insufficient strength of the connection of the grid decks.

In the present invention, the grid decks contain shear-resisting plates pre-cast therein. The shear-resisting plates protrude from the sides of a grid deck. When grid decks are laid on the beams, it is the shear-resisting plates that contact the beams. In other words, the grid decks do not directly contact the beams. Accordingly, if two grid decks need a wider gap, appropriate shear-resisting plates can be selected to pre-cast in the grid decks so that the width of the gap between two grid decks will not be limited by the width of the beams and will have a larger width and, moreover, the strength of the connection between grid decks will be increased.

DETAILED DESCRIPTION

Figure 1:
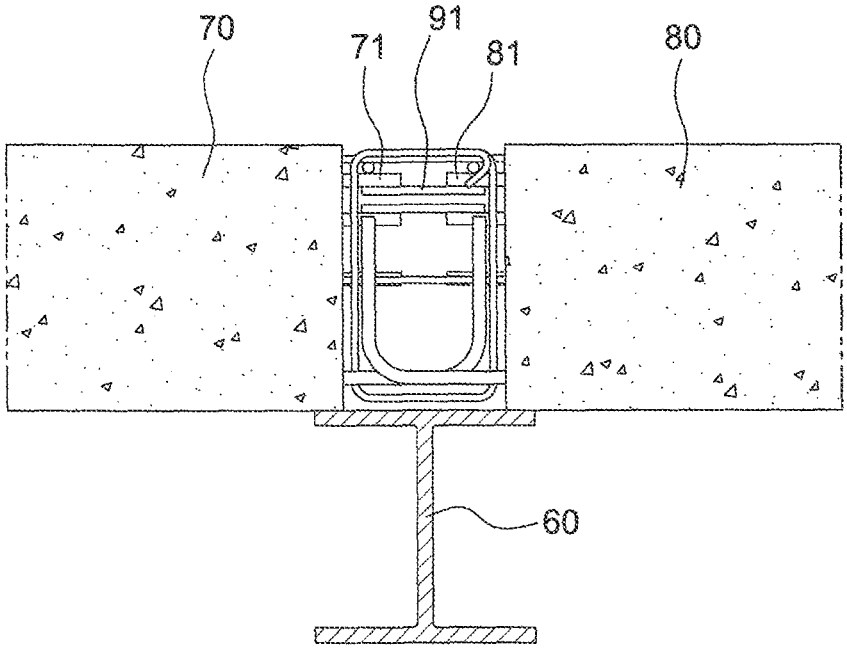
FIG. 1 shows normal grid decks laid on a beam.
Figure 2:
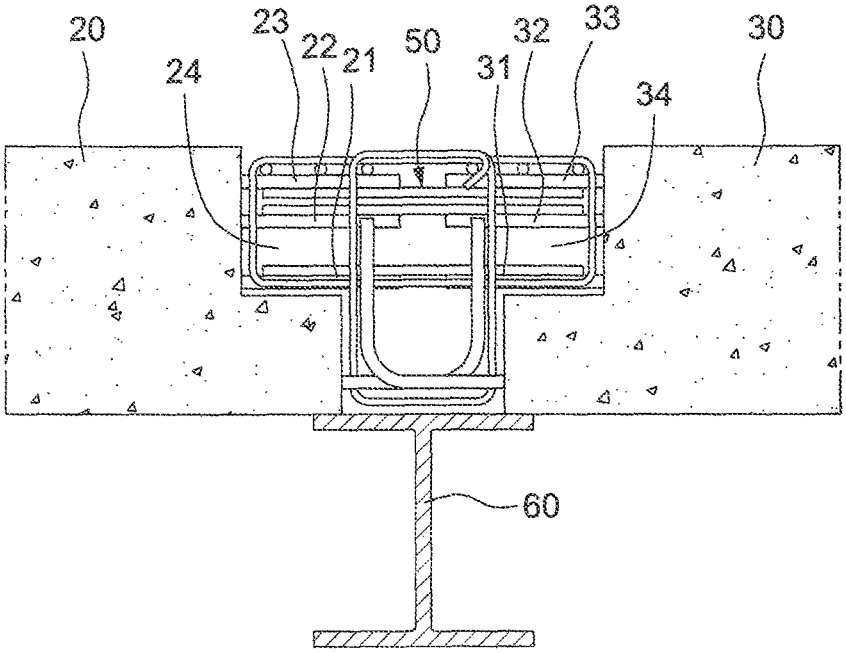
FIG. 2 shows a modification of grid decks shown in FIG. 1.
Figure 3:
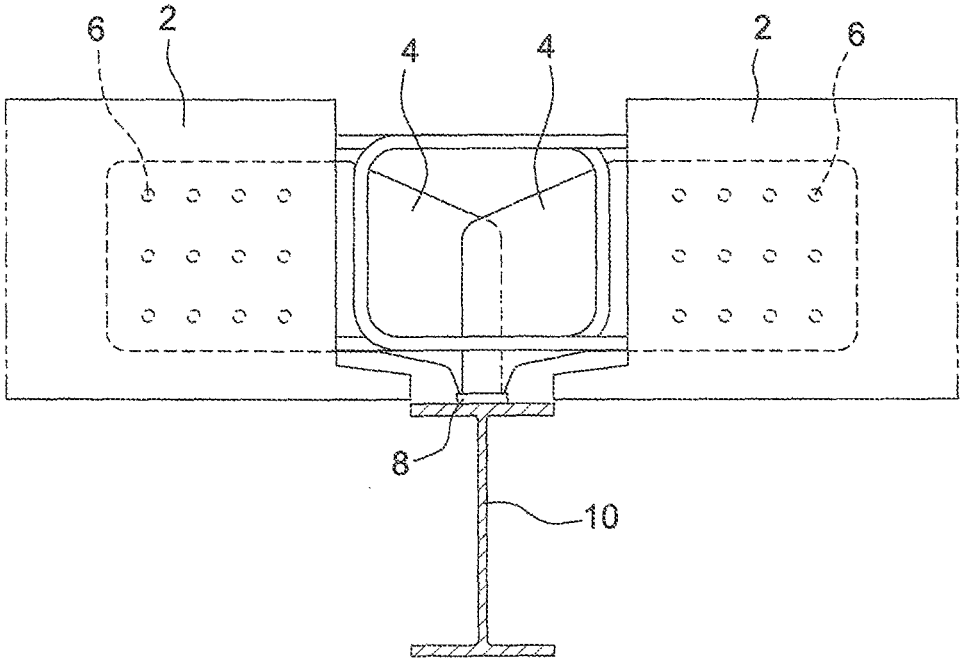
FIG. 3 shows the grid decks with shear-resisting plates of the present invention.
Figure 4:
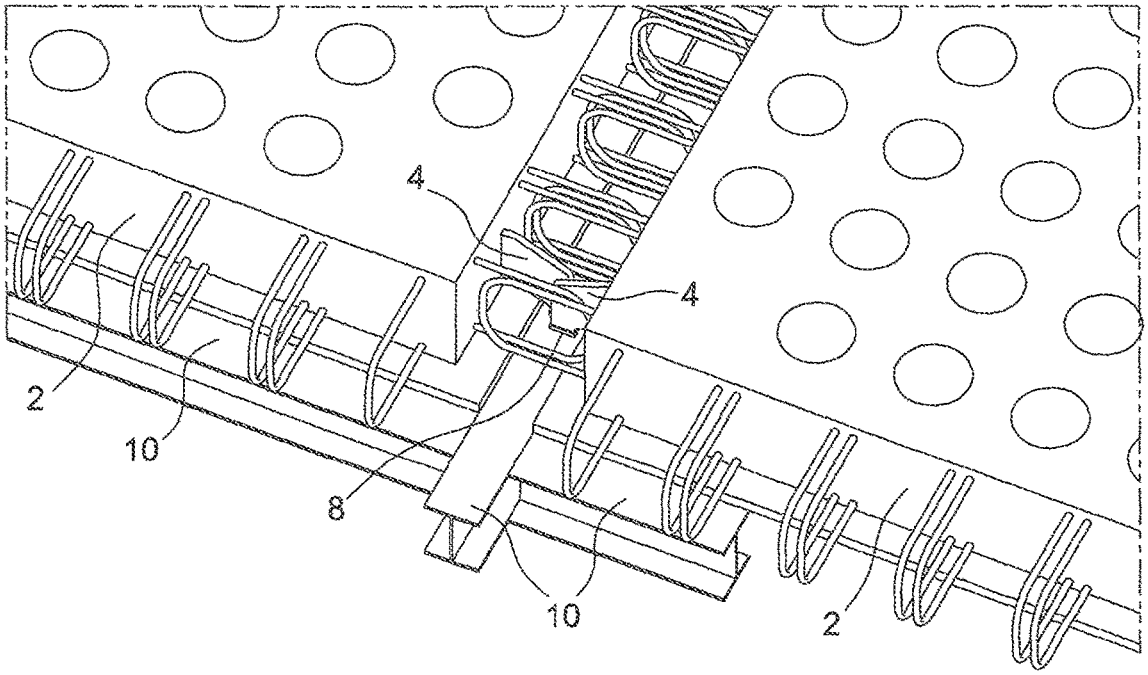
FIG. 4 shows the grid decks of the present invention which are connected to each other.
Figure 5:
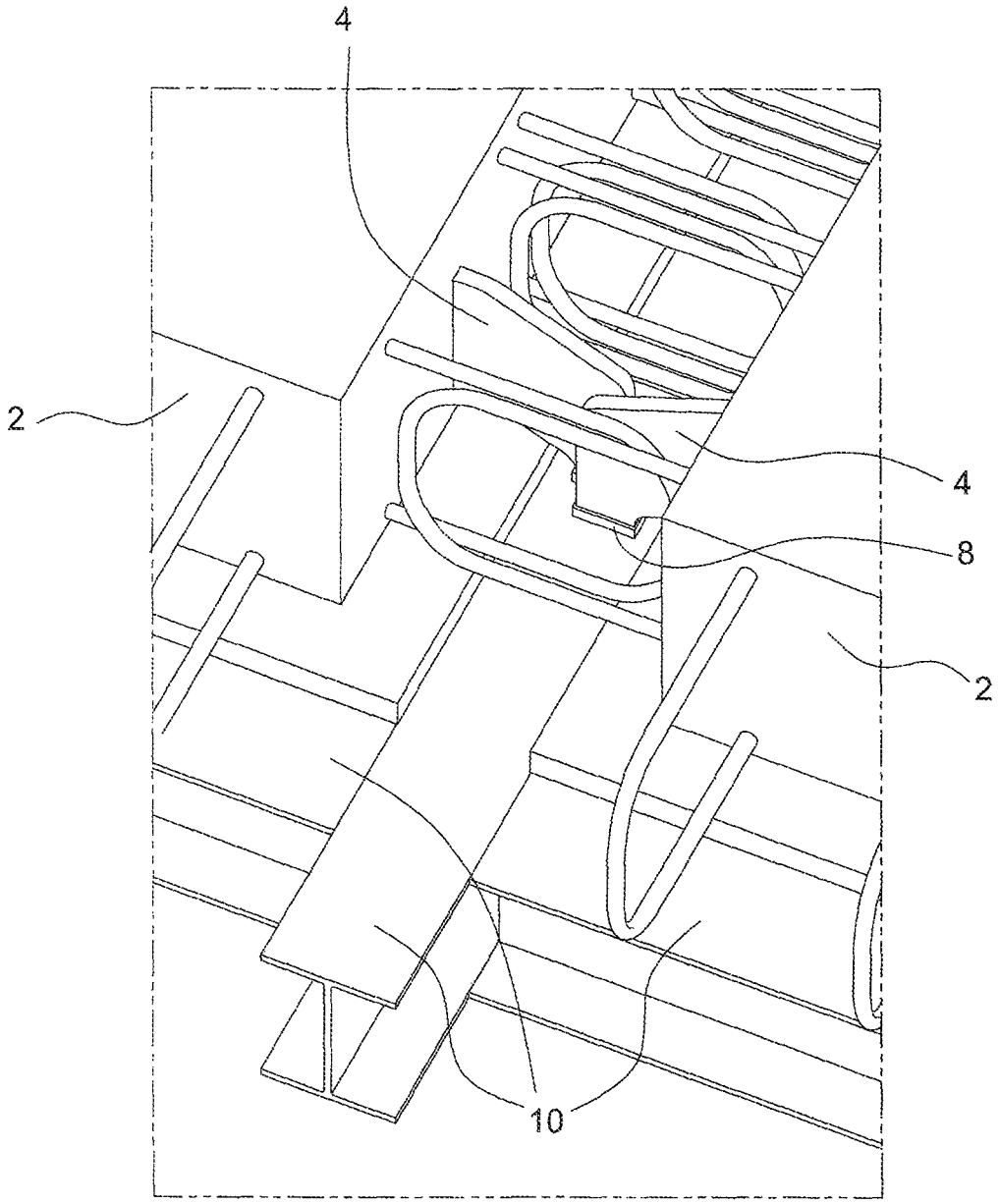
FIG. 5 shows a partially enlarged view of FIG. 4.
Figure 6:
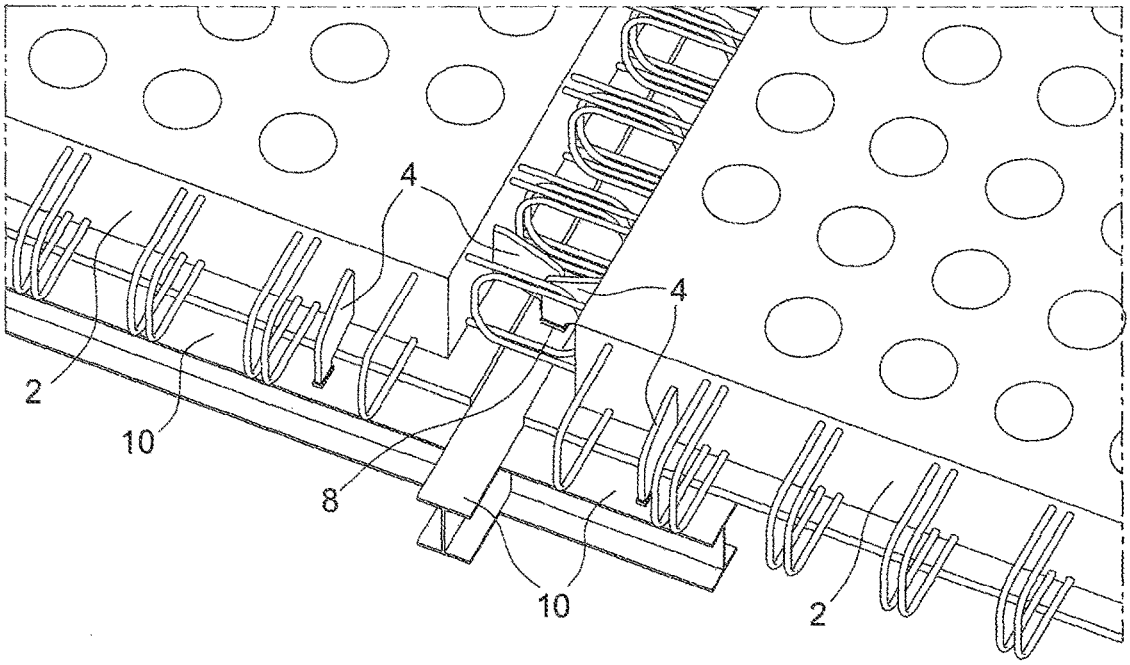
FIG. 6 shows another embodiment of the grid decks with shear-resisting plates.

Conventional grid decks are generally of rectangular shape. Their side surfaces are provided with connecting bars 71, 81, and lap-joint bars 91 (shown in FIG. 1) or connecting bars 21, 22, 23 and 31, 32, 33, and lap-joint bars 50 (shown in FIG. 2). When grid decks 20, 30 are interconnected, the connecting bars 21, 22, 23 and 31, 32, 33 are connected and grout is filled so that the grid decks 20, 30 will be secured to each other. The grid decks 2 of the present invention are shown in FIG. 3, where the side surfaces thereof are provided with shear-resisting plates 4. The shear-resisting plates 4 are pre-cast in a grid deck 2 with a part protruding out of the grid deck 2. The shear-resisting plate 4 may have a plurality of shear spikes 6, which will increase the connection strength between them and the grid deck 2. As shown in FIGS. 4 and 5, the positions at which the shear-resisting plates are pre-cast are selected near the corners of the grid deck 2 so that the grid deck has a shear-resisting plate 4 protruding from one side surface at one corner and another shear-resisting plate 4 protruding from the opposite side surface; or a shear-resisting plate 4 protruding from each of two perpendicular side surfaces at each corner (FIG. 6). Referring to FIG. 3, the shear-resisting plate 4 protruding from the side surface of the grid deck 2 has a lower edge which is about the same level of the bottom surface of the grid deck.

The grid deck 2 with shear-resisting plates 4 can be connected with another grid deck 2 with shear-resisting plates 4 to form a continuous floor. As described above, the connecting bars, lap-joint bars, and shear-resisting plates 4 protruding into the gap between grid decks 2 will securely fix two grid decks after grout is filled into the gap and cured.

As shown in FIGS. 3, 4, and 5, grid decks 2 are connected above, the top surfaces of the beams 10. It is similar to conventional grid decks shown in FIGS. 1 and 2. The difference is that a conventional grid deck (FIG. 1) is laid on top of the beam 60 and contacts the top surface of the beam, whereas in the present invention, the shear-resisting plates 4 protruding into the gap between two grid decks 2 contact the top surface of the beams 10 with their lower edges (FIG. 3). Accordingly, the grid deck 2 does not directly contact the beam 10, and the gap between two grid decks 2 is not limited by the width of the beams. Even though the width of the beam is very small, the gap between grid decks can still be maintained in sufficient width if an appropriate size of shear-resisting plates is selected. The sufficient width of gap allows the connecting bars to have a sufficient length to provide high connection strength between grid decks after grout is filled into the gap between the grid decks. If necessary, a gasket 8 (shown in FIG. 3) can be inserted into the position where the shear-resisting plate contacts the beam in order to adjust the level of the grid, deck 2.

From the foregoing, it will be appreciated that, although specific embodiments of the invention have been described herein for purposes of illustration, various modifications may be made without departing from the spirit and scope of the embodiments described herein.

What is claimed is:

1. A construction structure comprising:

a first grid deck comprising:

a plurality of first shear-resisting plates, each of which has a first part pre-cast in the first grid deck and has a second part protruding out of a first side of the first grid deck wherein the second part is extending and tapering from the first part, the second part having a first lower edge;

a second grid deck comprising:

a plurality of second shear-resisting plates, each of which has a third part pre-cast in the second grid deck and has a fourth part protruding out of a second side of the second grid deck wherein the fourth part is extending and tapering from the third part, the fourth part having a second lower edge; and a first I-beam disposed between the first side of the first grid deck and the second side of the second grid deck for supporting the first lower edge of each of the plurality of the first shear-resisting plates and the second lower edge of each of the plurality of second shear-resisting plates;

wherein the second part of each of the plurality of first shear-resisting plates overlaps with the fourth part of each of the plurality of second shear-resisting plates in a direction perpendicular to the lengthwise direction of the I-beam wherein the overlapped dimension is less than the length of the first lower edge of each of the plurality of the first shear-resisting plates or the length of the second lower edge of each of the plurality of second shear-resisting plates, and wherein the first lower edge of each of the plurality of the first shear-resisting plates and the second lower edge of each of the plurality of second shear-resisting plates are at the same level of the bottom surfaces of the first grid deck and second grid deck.

2. The construction structure of claim 1 wherein a width of the first I-beam is smaller than the distance between the first side of the first grid deck and second side of the second grid deck so that the first and second grid decks do not contact the first I-beam, wherein each of the length of the first lower edge of each of the plurality of the first shear-resisting plates and the length of the second lower edge of each of the plurality of second shear-resisting plates is smaller than the width of the first I-beam and wherein each of the first and second shear-resisting plates comprises a plurality of shear spikes thereon.

3. The construction structure of claim 2 wherein each of the first and second shear-resisting plates is pre-cast in regions near corners of the first grid deck or the second grid deck.

4. The construction structure of claim 3 wherein the first grid deck further comprises a third shear-resisting plate protruding out of a third side of the first grid deck wherein the first side of the first grid deck is perpendicular to the third side of the first grid deck.

5. The construction structure of claim 4 wherein the second grid deck further comprises a fourth shear-resisting plate protruding out of a fourth side of the second grid deck wherein the second side of the second grid deck is perpendicular to the fourth side of the second grid deck.

6. The construction structure of claim 5 further comprising a second I-beam wherein a lower edge of the third shear-resisting plates of the first grid deck and a lower edge of the fourth shear-resisting plates of the second grid deck are disposed on a top surface of the second I-beam.

7. The construction structure of claim 6 wherein the first I-beam intersects with second I-beam and a top surface of the first I-beam is flush with the top surface of the second I-beam.

8. The construction structure of claim 7 wherein a gasket is inserted between the first lower edge of each of the first shear-resisting plates and the first I-beam.

9. The construction structure of claim 8 wherein a gasket is inserted between the second lower edge of each of the second shear-resisting plates and the first I-beam.

* * * * *